US006203068B1

(12) United States Patent
Petkovsek

(10) Patent No.: US 6,203,068 B1
(45) **Date of Patent: *Mar. 20, 2001**

(54) SPECIAL SERVICE MAILING ASSEMBLY WITH LABEL, TRACKING AREA AND RECEIPT AND A METHOD FOR PREPARING A MAILPIECE FOR DELIVERY

(76) Inventor: Glenn Petkovsek, 2 Saverne Cir., Little Rock, AR (US) 72223

( * ) Notice: Subject to any disclaimer, the term of this patent is extended or adjusted under 35 U.S.C. 154(b) by 0 days.

This patent is subject to a terminal disclaimer.

(21) Appl. No.: 09/286,819

(22) Filed: Apr. 6, 1999

Related U.S. Application Data

(63) Continuation-in-part of application No. 08/878,046, filed on Jun. 18, 1997, now Pat. No. 5,915,730.

(51) Int. Cl.[7] ..... B42D 15/00

(52) U.S. Cl. ..... 283/79; 283/80; 283/81; 283/101; 283/105; 283/106

(58) Field of Search ..... 283/79, 80, 81, 283/101, 105, 106; 229/300

(56) References Cited

U.S. PATENT DOCUMENTS

| | | | | |
|---|---|---|---|---|
| 4,418,865 | | 12/1983 | Bowen . | |
| 4,492,334 | | 1/1985 | Dicker . | |
| 4,565,317 | | 1/1986 | Kranz . | |
| 4,682,793 | | 7/1987 | Walz . | |
| 4,824,142 | * | 4/1989 | Dossche | 283/15.5 |
| 5,183,203 | | 2/1993 | Sanders . | |
| 5,190,210 | | 3/1993 | Walz . | |
| 5,348,780 | * | 9/1994 | Boggs et al. | 428/42 |
| 5,376,048 | * | 12/1994 | Whiteside | 462/6 |
| 5,476,420 | * | 12/1995 | Manning | 462/6 |
| 5,507,526 | | 4/1996 | Petkovsek . | |
| 5,520,990 | * | 5/1996 | Rotermund | 428/195 |
| 5,752,647 | * | 5/1998 | Schubert et al. | 229/92.1 |
| 5,862,978 | * | 1/1999 | Forrest | 229/70 |
| 5,915,730 | * | 6/1999 | Petkovsek | 283/79 |

* cited by examiner

*Primary Examiner*—Willmon Fridie, Jr.
(74) *Attorney, Agent, or Firm*—Patents & TMS P.C.

(57) ABSTRACT

A mailing assembly for use in connection with non-domestic delivery of a mailpiece wherein the sender of the mailpiece is required to complete the sender's declaration. The assembly includes a mailing label, a tracking area, and a backing sheet. Alternatively, the assembly includes a mailing label, a tracking area, a receipt card, and a backing sheet. The mailing label and tracking area are detachably connected to each other and form an entirely complete mailing form. The mailing label, the tracking area, and the receipt card may form the entirety of the mailing form. Such form is adhesively connected to the backing sheet. An adhesive layer is provided between the mailing form and the backing sheet. The sender provides all of the necessary information on the mailing label relating to the contents of the mailpiece being delivered. The sender may also add a machine-readable code to the tracking area which aids in the tracking of the mailpiece. The sender also alternatively completes a receipt card which serves as a declaration in compliance with U.S. Customs' requirements. Upon completion, the receipt card is detached from the tracking area and retained by the U.S. Postal Service for recording purposes.

20 Claims, 5 Drawing Sheets

SPECIAL SERVICE MAILING ASSEMBLY WITH LABEL, TRACKING AREA AND RECEIPT AND A METHOD FOR PREPARING A MAILPIECE FOR DELIVERY

This application is a continuation-in-part of U.S. patent application Ser. No. 08/878,046, filed Jun. 18, 1997, now U.S. Pat. No. 5,915,730.

BACKGROUND OF THE INVENTION

The present invention generally relates to a form for printing information relating to mail handling for attachment to a mailpiece. More specifically, the present invention relates to a multi-part form including a mailing label, a tracking area and a detachable receipt card for non-domestic delivery of a mailpiece.

It is, of course, known to provide specialized postal processing and handling of particular mailpieces requiring delivery via Foreign Airmail. Such special services include the preparation of specialized customs/postal forms which certify that the sender of the mailpiece is complying with U.S. Customs requirements with regard to the mailing of the mailpiece.

Traditionally, PS Form 2976 has been used on those packages for Foreign Airmail which are substantially flat (i.e., envelopes and folders). Conversely, PS Form 2976-A has been used for larger, box-type packages. PS Form 2976 is a simple label which may be affixed directly to the outside of the appropriate mailpiece. On this form, the sender of the mailpiece must indicate the weight, value and description of the contents of the mailpiece. PS Form 2976, does not, however, require either a sender's signature or sender's declaration attesting to the contents of the mailpiece. Should the envelope or folder which is being mailed contain any merchandise or merchandise samples, the sender may be required to complete a separate Parcel Post Customs Declaration Form 2966-A which is then retained by the U.S. Postal Service.

PS Form 2976-A is a quadruplicate mailing form which incorporates a customs declaration. This form also requires that a signature be received from the addressee upon delivery of the mailpiece. Once imprinted with the necessary information, PS Form 2976-A is inserted into a see-through mailing envelope which is, in turn, affixed to the mailpiece for delivery.

However, due to recent changes in U.S. Postal regulations, if a package weighing 16 ounces or greater is to be sent via Foreign Airmail, the sender of the package must complete a sender's declaration. Accordingly, many envelopes an folders which previously only required the affixation of PS Form 2976 now also require that a separate Form 2966-A be completed (Customs Declaration).

Given the tremendous increase in the number of Foreign Airmail packages which now require the completion of both a mailing label and a Customs Declaration, there is an increased need for an improved multi-purpose Foreign Airmail mailing form which includes both a mailing label and a sender's declaration and which can be prepared in the most efficient way possible.

SUMMARY OF THE INVENTION

The present invention provides a mailing form for the non-domestic delivery of a mailpiece, particularly envelopes and folders, wherein the form includes both a mailing label and a detachable sender's declaration. In addition, the present invention provides a method for preparing a mailpiece for non-domestic delivery wherein a mailing label is affixed to the mailpiece and a corresponding sender's declaration is retained by the U.S. Postal Service.

To this end, in an embodiment of the present invention, a mailing assembly is provided for use in connection with non-domestic delivery of a mailpiece holding contents for delivery thereof. The assembly has a backing sheet and a mailing form is removably attached to the backing sheet. The form is variably printed with information necessary to comply with requirements for delivery of the mailpiece including data concerning the contents of the mailpiece wherein a mailing label forms a first portion of the form and a tracking area forms a second portion of the mailing form.

In an embodiment, an adhesive layer is provided between the mailing form and the backing sheet.

In an embodiment, a machine-readable code section is provided in the tracking area including machine-readable information associated with the mailpiece.

In an embodiment, the tracking area is detachable from the mailing label.

In an embodiment, a second mailing form is removably attached to the backing sheet and detachably connected to the first mailing form.

In an embodiment, an adhesive layer is provided between the second mailing form and the backing sheet.

In an embodiment, a machine-readable code section is provided on the second mailing form.

In another embodiment of the present invention, a mailing assembly is provided for use in connection with non-domestic delivery of a mailpiece holding contents for delivery thereof. The assembly has a backing sheet. A mailing form is removably attached to the backing sheet. The form is variably printed with information necessary to comply with requirements for delivery of the mailpiece including data concerning the contents of the mailpiece. A mailing label forms a first portion of the mailing form. A tracking area forms a second portion of the mailing form, and a receipt card forms a third portion of the mailing form.

In an embodiment, the backing sheet is removably attached to the mailing label and the tracking area and not the receipt card.

In an embodiment, a machine-readable code section is provided on the tracking area including machine-readable information associated with the mailpiece.

In an embodiment, the receipt card is detachable from the tracking area.

In an embodiment, the tracking area is detachable from the mailing label.

In an embodiment, a second backing sheet is detachably connected to the first backing sheet. A second mailing form is removably attached to the backing sheet and detachably connected to first mailing form.

In an embodiment, an adhesive layer is provided between the mailing form and the backing sheet.

In an embodiment, a machine-readable code section is provided on the second mailing form.

In another embodiment of the present invention, a method is provided for preparing a mailpiece for non-domestic delivery of the mailpiece wherein the mailpiece has contents for delivery thereof, the method comprising the steps of: providing a mailing form removably attached to a backing sheet wherein the mailing form comprises a mailing label forming a first portion of the mailing form and a tracking area forming a second portion of the mailing form wherein the tracking area is removably connected to the mailing label; printing information on the form necessary to comply with requirements for delivery of the mailpiece including data relating to the contents of the mailpiece; removing the form from the backing sheet; and attaching the form to the mailpiece.

In an embodiment a machine-readable code section is provided on the tracking area and printing machine-readable information associated with the mailpiece on the machine-readable code section is provided.

In an embodiment, a receipt card is provided forming a third portion of the mailing form wherein the receipt card is detachable connected to the tracking area.

In an embodiment, sender information is entered on the receipt card. Addressee information is entered on the receipt card and the receipt card is removed from the tracking area.

In an embodiment, the tracking area is detached from the mailing label.

It is, therefore, an advantage of the present invention to provide an improved mailing assembly for use in connection with the non-domestic delivery of a mailpiece.

Another advantage of the present invention is to provide an assembly and a method for use in connection with the non-domestic delivery of a mailpiece without requiring additional adhesives or fixatives for attaching the same to a mailpiece.

Yet another advantage of the present invention is to provide an assembly which includes both a mailing label and a sender's declaration which may be used in connection with the non-domestic delivery of a mailpiece; particularly, envelopes and folders.

Moreover, an advantage of the present invention is to provide a mailing assembly for use in connection with the non-domestic delivery of a mailpiece which may be thermally imprinted with information.

Another advantage of the present invention is to provide an assembly and method for use in connection with the non-domestic delivery of a mailpiece which allows the sender to complete but a single form.

A further advantage of the present invention is to provide a simplified assembly and method for use in connections with the non-domestic delivery of a mailpiece.

Additionally, it is an advantage of the present invention to provide an assembly for use in connection with the non-domestic delivery of a mailpiece which is practical and economical.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
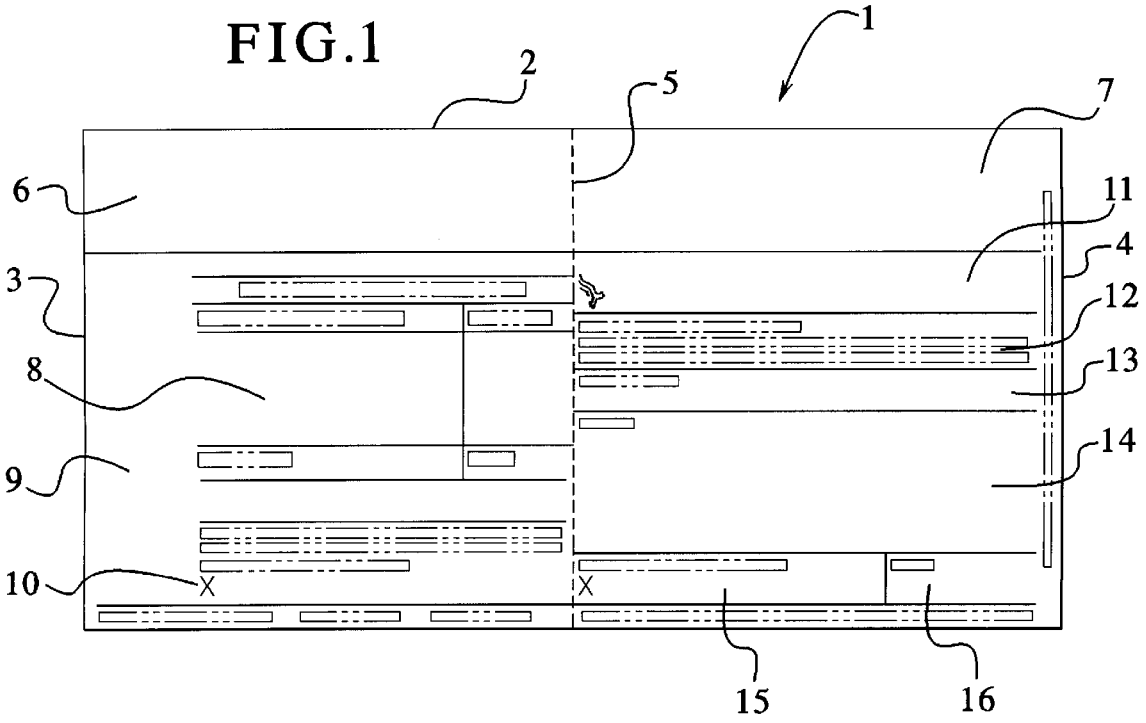
FIG. 1 illustrates a plan view of a front side of an embodiment of the mailing assembly of the present invention.

Referring now to the drawings, wherein like numerals refer to like parts, FIG. 1 is a front-plan view that generally illustrates an embodiment of a mailing assembly 1 formed, in part, from a mailing form 2. The mailing form 2 has a mailing label 3 and a receipt card 4; the mailing label 3 and the receipt card 4 are detachably connected along a mailing form tear line 5.

Among other things, the mailing label 3 includes the type of information traditionally found on PS Form 2976. Indeed, the mailing label 3 includes a mailpiece information area 8 which required the disclosure of the contents of the mailpiece, the weight of the mailpiece and the estimated value of the contents of the mailpiece. In addition, the mailing label 3 includes a label tracking area 9 capable of being variably printed with information necessary to track the associated mailpiece. Furthermore, the mailing label 3 includes a label signature area 10 for receipt of the signature of the sender (or agent) of the mailpiece.

The embodiment shown in FIG. 1 further includes an auxiliary information area 6 on the mailing label 3 which is capable of being imprinted with variable information relating to the non-domestic delivery of the associated mailpiece. For instance, if delivery of the mailpiece is exempt from U.S. Customs' requirements because the mailpiece has a military purpose, the auxiliary information 6 might be imprinted with the words "Contents for Official Use, Exempt from Customs; Requirements-Military Service."

Detachably connected to the mailing label 3 via the mailing form tear line 5 is the receipt card 4. Functionally, the receipt card 4 serves the same purpose as the altogether separate Form 2966-A, Parcel Post Customs Declaration. Thus, the receipt card 4 includes a receipt card tracking area 11 capable of being variably printed with information similar, if not identical, to that which is imprinted in the label tracking area 9 of the mailing label 3.

Also included on the receipt card 4 is a declaration area 12 which is imprinted with a standard declaration statement to which the sender of the mailpiece attests. Sender information area 13 of the receipt card may include the name of the sender of the mailpiece which sender address area 14 may include the address of the sender. Receipt card signature area 15, much like the label signature area 10, may be included for the signature of the sender (or agent) of the mailpiece. At the same time, the sender of the mailpiece enters the appropriate date in a date area 16. The receipt card 4 is preferably provided with a second auxiliary information area 7 intended to be variably imprinted with such optional information as that found, and previously described, in the auxiliary information area 6 of the mailing label 3.

Figure 2:
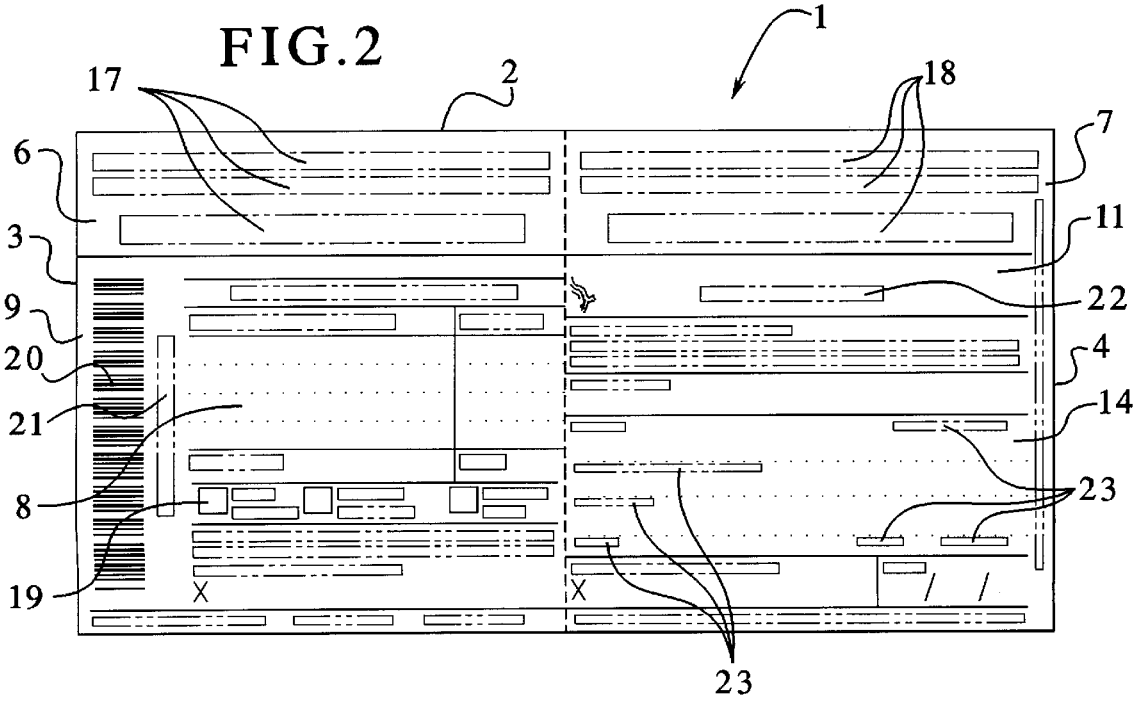
FIG. 2 illustrates a plan view of a front side of an embodiment of the mailing assembly of the present invention having variable information imprinted thereon.

FIG. 2 offers a front view of the embodiment of the mailing assembly 1 from FIG. 1 complete with a variety of variably printed information thereon. Indeed, one of the key advantages of the present invention is that the mailing assembly 1 may be imprinted with such variable information through the use of a thermal printer. Such variable information includes, for example, the auxiliary information 17 within the auxiliary information area 6. Again, the present invention contemplates that a variety of auxiliary information 17 may be imprinted within the auxiliary information area 6 as this is merely an optional informative section, something which is not currently found on PS Form 2976. Additional variably printed information may include a bar code 20 and tracking number 21 placed upon the label tracking area 9. This machine-readable information is intended to be compatible with the United States Postal Service's existing track and trace network. Other variably printed information includes the contents information 19 within the mailpiece information area 8 which includes descriptive boxes by which the sender of the mailpiece may generally identify the contents of the mailpiece.

The receipt card 4 of the mailing form 2 may also be imprinted with variable information. The auxiliary information 18 placed within the second auxiliary information area 7 is intended to be the same as the auxiliary information 17 imprinted upon the mailing label 3. Similarly, a tracking number 22 within the receipt card tracking area 11 may be identical to the tracking number 21 imprinted upon the mailing label 3. Lastly, a variety of specific address queries 23 are preferably imprinted within the center address area 14 for clarity and simplicity.

Figure 3:
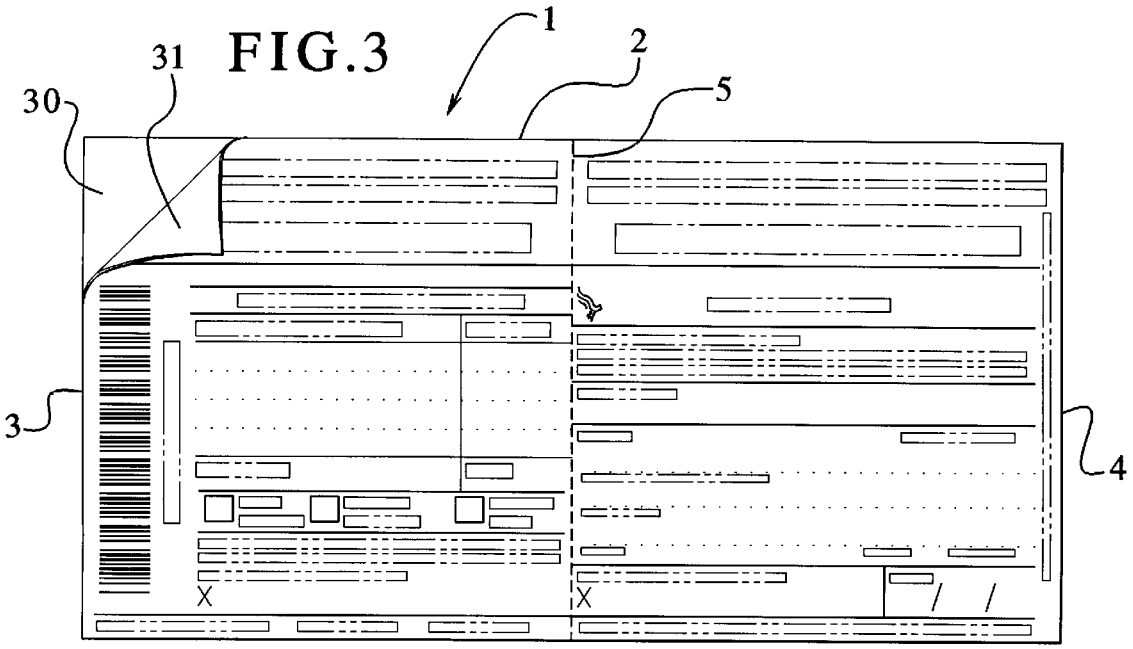
FIG. 3 illustrates a plan view of a front side of an embodiment of the mailing assembly of the present invention with one corner partially peeled away from an associated backing sheet.

Turning now to FIG. 3, the complete mailing assembly 1 from FIG. 2 is shown whereby an upper left-hand corner of the mailing label 3 is partially peeled away from an associated backing sheet 30. Each mailing assembly 1 has a backing sheet 30 which is approximately the same size and shape as the mailing form 2 which is affixed thereupon, only the mailing label 3 of the mailing form 2, however, is provided with an adhesive layer 31 for detachable adhesion to the backing sheet 30. That is, there is no adhesive layer between the receipt card 4 of the mailing form 2 and the backing sheet 30. Again, the dividing line between the mailing label 3 and the receipt card 4 is defined by the mailing form tear line 5. The adhesive layer 31 serves the dual purpose of initially securing the mailing form 2 to the backing sheet 30 and, after the mailing label 3 is peeled away from the backing sheet 30, of subsequently permanently affixing the mailing label 3 to the desired mailpiece. It should be noted that the receipt card 4 is typically detached from the mailing label 3 prior to the mailing label 3 being permanently affixed to the desired mailpiece.

Indeed, in keeping with current U.S. Postal Customs' requirements, the receipt card 4 may be detached from the mailing label 3 and retained by the U.S. Postal Service immediately after the entire mailing form 2 is filled out by the sender of the mailpiece and presented to a U.S. Postal employee. Thereafter, that mailing label 3 may be peeled away from the backing sheet 30 and immediately placed upon the mailpiece for delivery.

Figure 4:
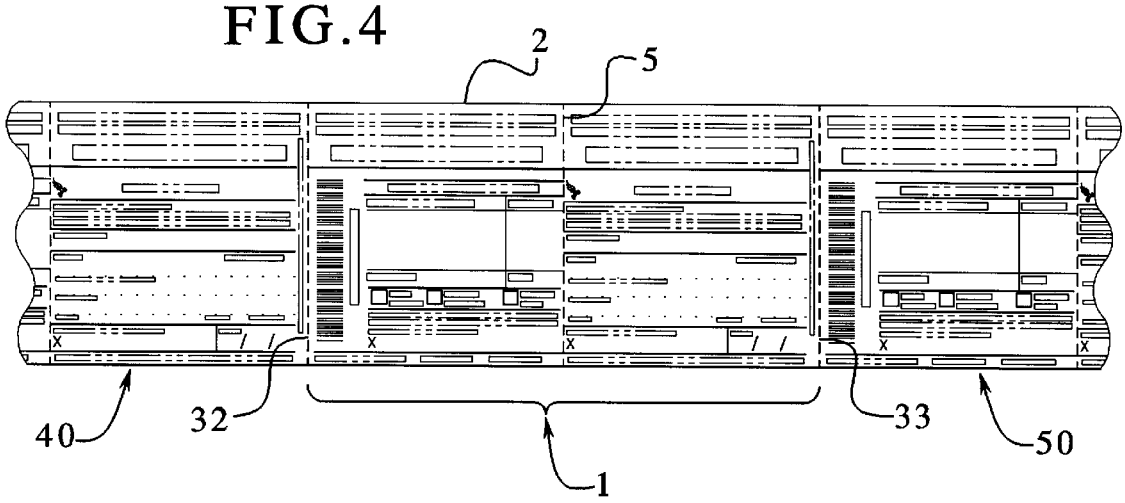
FIG. 4 illustrates a plan view of front sides of a plurality of mailing assemblies of the present invention detachably connected in end-to-end fashion.

FIG. 4 shows another embodiment of the present invention whereby a number of mailing assemblies are continuously and detachably interconnected (end-to-end, for example) such that the mailing assemblies may be provided on a reel or roll. Such reel or roll may be provided for use with, for example, some form of dispensing device. As shown in FIG. 4, the mailing assembly 1 is connected on one of its edges to a second mailing assembly 40 and on the other of its edges to a third mailing assembly 50. The mailing assembly 1 is detachably connected to the second mailing assembly 40 via a first mailing assembly tear line 32 and is detachably connected to the third mailing assembly 50 via a second mailing assembly tear line 33. The mailing assembly tear lines 32 and 44 are perforations which go all the way through to, and may include, the associated backing sheets. Conversely, the mailing form tear line 5 perforates only the mailing form 2 and not the associated backing sheet 30.

Figure 5:
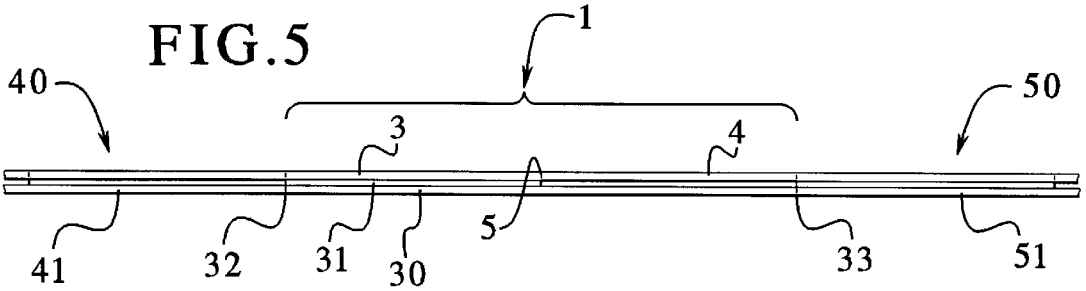
FIG. 5 illustrates a bottom-end view of the embodiments of the mailing assemblies shown in FIG. 4.

Looking now at FIG. 5, a bottom edge of the mailing assemblies from FIG. 4 is shown. Here it may be more clearly observed that the adhesive layer 31 of the mailing assembly 1 is disposed only between he mailing label 3 and the backing sheet 390 and not between the receipt card 4 and the backing sheet 30. Such is the case for all similar mailing assemblies 40, 50, etc. Also, as described in connection with FIG. 4, the first mailing assembly tear line 32 may perforate the entirety of both the mailing assembly 1 and the mailing assembly 40 including their respective backing sheets 30 and 41. Similarly, the second mailing assembly tear line 33 may perforate both the backing sheet 30 and the third backing sheet 51. Conversely, the mailing form tear line 5 of the mailing assembly 1 does not perforate the associated backing sheet 30 but only the associated mailing label 3 and the receipt card 4. Such design ensures that individual mailing assemblies which are provided on a reel or roll may be individually detached from the remaining mailing assemblies with relative ease and without fear of accidental separation of a mailing label from its associated receipt card.

Figure 6:
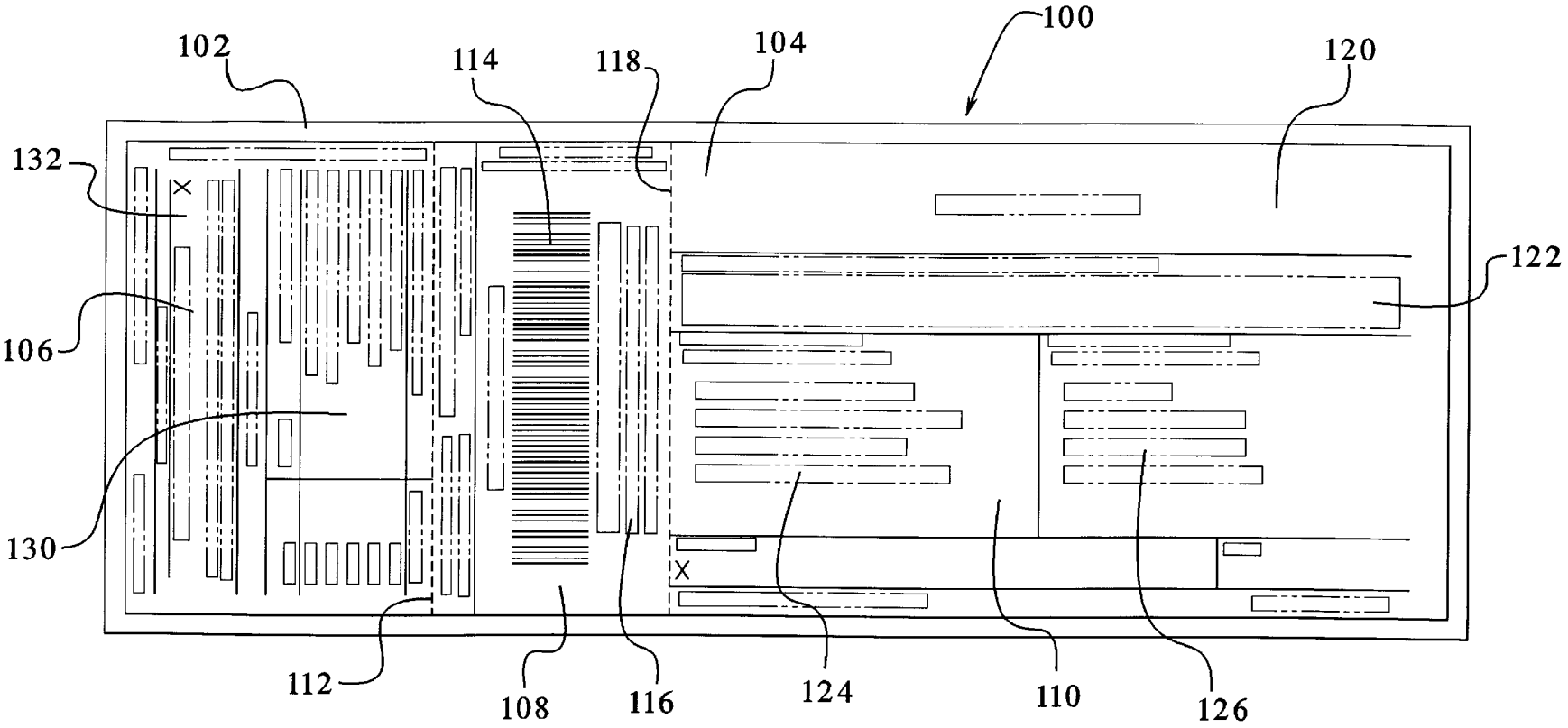
FIG. 6 illustrates a plan view of a front side of an embodiment of the mailing assembly of the present invention.

FIG. 6 illustrates another embodiment of a mailing assembly 100. The mailing assembly 100 includes a backing sheet 102. Further, the mailing assembly 100 includes a mailing form 104 that is removably attached to the backing sheet 102 by an adhesive (not shown in FIG. 6). The adhesive is applied between the mailing form 104 and the backing sheet 102 substantially as shown and described with reference to FIGS. 1–5. The mailing form 104 is separable into three portions: a mailing label 106, a tracking area 108 and a receipt card 110.

The mailing label 106 includes information traditionally found on United States Postal Service Form (PS) 2976. Generally, PS Form 2976 includes an area 130 which requires the disclosure of the contents of the mailpiece, the weight of the mailpiece and the estimated value of the contents of the mailpiece. Furthermore, the mailing label 106 includes a signature area 132 for the signature of the sender or agent of the mailpiece. The mailing label 106 is preferably distinctly colored with a background shade distinct from a remainder of the assembly 100. All of the information may be variably printed on the assembly 100, therefore, the assembly may be provided as a "blank" having no information printed thereon.

Detachably connected to the mailing label 106 via the mailing form tear line 112 is the tracking area 108. The tracking area 108 includes a machine-readable code section 114 capable of being variably printed with machine-readable information associated with the mailpiece. The machine-readable code section 114 aids in tracking the associated mailpiece. Additionally, auxiliary information may be variably printed on the tracking area 108 in an auxiliary information area 116, the auxiliary information relating to the delivery of the associated mailpiece. For example, if delivery of the mailpiece is exempt from U.S. Customs' requirements because the mailpiece has a military purpose, the auxiliary information area 116 may be imprinted with the words "Contents for Official Use, Exempt from Customs' Requirements-Military Service."

Detachably connected to the tracking area 108 via a tear line 118 is the receipt card 110. Functionally, the receipt card 110 serves the same purpose as the altogether separate PS Form 2966-A, Parcel Post Customs' Declaration. The receipt card 110 includes a receipt card tracking area 120 capable of being variably printed with information similar to, if not identical to, that which is imprinted in the tracking area 108.

Also included on the receipt card 110 is a Sender's Declaration area 122 which may be printed with the standard declaration statement to which the sender of the mailpiece attests. Sender information area 124 may include the address of the sender. Additionally, addressee address area 126 may include the address of the addressee.

A preferable embodiment of the present invention includes a backing sheet removably attached by an adhesive to the mailing label 106 and the tracking area 108. The adhesive does not extend to the receipt card 110 (not shown).

Figure 7:
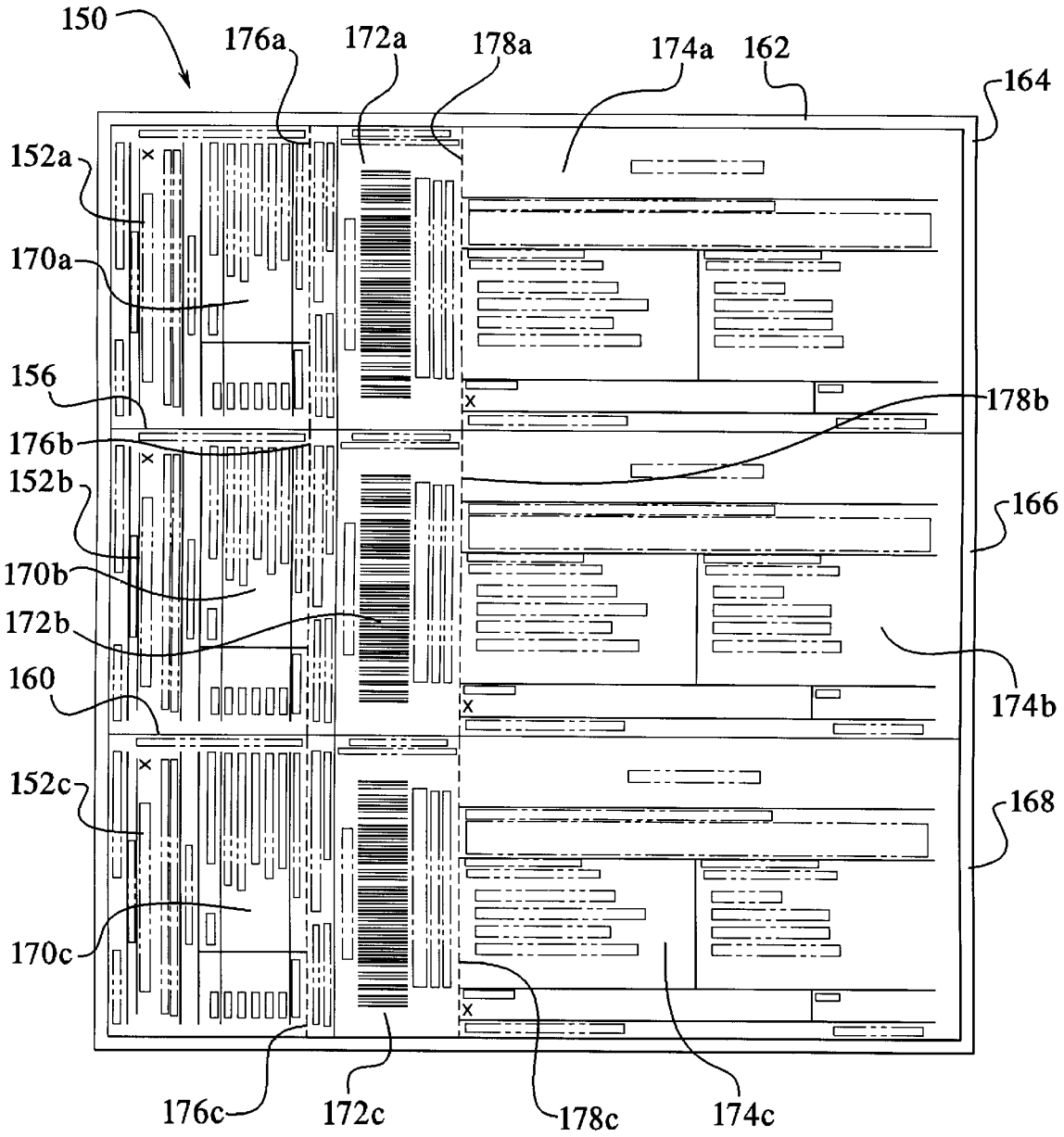
FIG. 7 illustrates a plan view of front sides of three mailing assemblies of the present invention detachably connected.

FIG. 7 illustrates yet another embodiment of the present invention whereby a plurality of mailing assemblies 152*a*, 152*b* and 152*c* are detachably connected such that the mailing assemblies 152*a*, 152*b* and 152*c* may be provided on a single sheet 150. As shown in FIG. 7, the sheet 150 includes a first mailing assembly 152*a* detachably connected along its bottom edge to a second mailing assembly 152*b* via a tear line 156. The mailing assembly 152*b* may be detachably connected along its bottom edge to a third mailing assembly 152*c* via a tear line 160. The sheet 150 may be provided for use with, for example, a printing mechanism to provide printed information. Specifically, the sheet 150 may be fed through a laser printer.

The sheet 150 includes a backing sheet 162 removably attached to the mailing assemblies 152*a*, 152*b* and 152*c* via an adhesive (not shown). The tear lines 156,160 may extend through the backing sheet 162 subdividing backing sheet 162 into three separable backing sheets 164, 166, and 168. Alternatively, the tear lines 156, 160 may extend only through the mailing assemblies 152*a*, 152*b*, and 152*c* leaving the backing sheet 162 intact as a single backing sheet. The mailing assemblies 152*a*, 152*b*, and 152*c* are all similar mailing assemblies to the mailing assembly 104 of FIG. 6. The mailing assemblies 152*a*, 152*b* and 152*c* include tear lines 176*a*, 176*b* and 176*c* separating each of the mailing assemblies 152*a*, 152*b* and 152*c* into three portions: mailing labels 170*a*, 170*b* and 170*c*, tracking areas 172*a*, 172*b* and 172*c*, and receipt cards 174*a*, 174*b* and 174*c*, respectively. The mailing labels 170*a*, 170*b* and 170*c* are separable from the tracking areas 172*a*, 172*b* and 172*c* via tear lines 176*a*, 176*b* and 176*c*, respectively. The tracking areas 172*a*, 172*b* and 172*c* are separable from the receipt cards 174*a*, 174*b* and 174*c* via tear lines 178*a*, 178*b* and 178*c*, respectively.

The mailing labels 170*a*, 170*b* and 170*c* include information traditionally found on PS Form 2976. The mailing labels 170*a*, 170*b* and 170*c* are preferably distinctly colored with a background shade distinct from a remainder of the assemblies 152*a*, 152*b* and 152*c*. All of the information may be variably printed on the mailing assemblies 152*a*, 152*b* and 152*c*; therefore, the mailing assemblies 152*a*, 152*b* and 152*c* may be provided as a "blank" having no information printed thereon.

Figure 9:
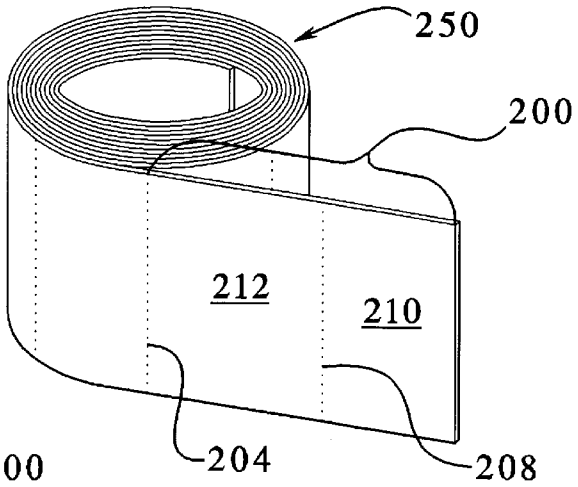
FIG. 9 illustrates a perspective view of a plurality of mailing assemblies of the present invention detachably connected in end-to-end fashion and rolled.
Figure 8:
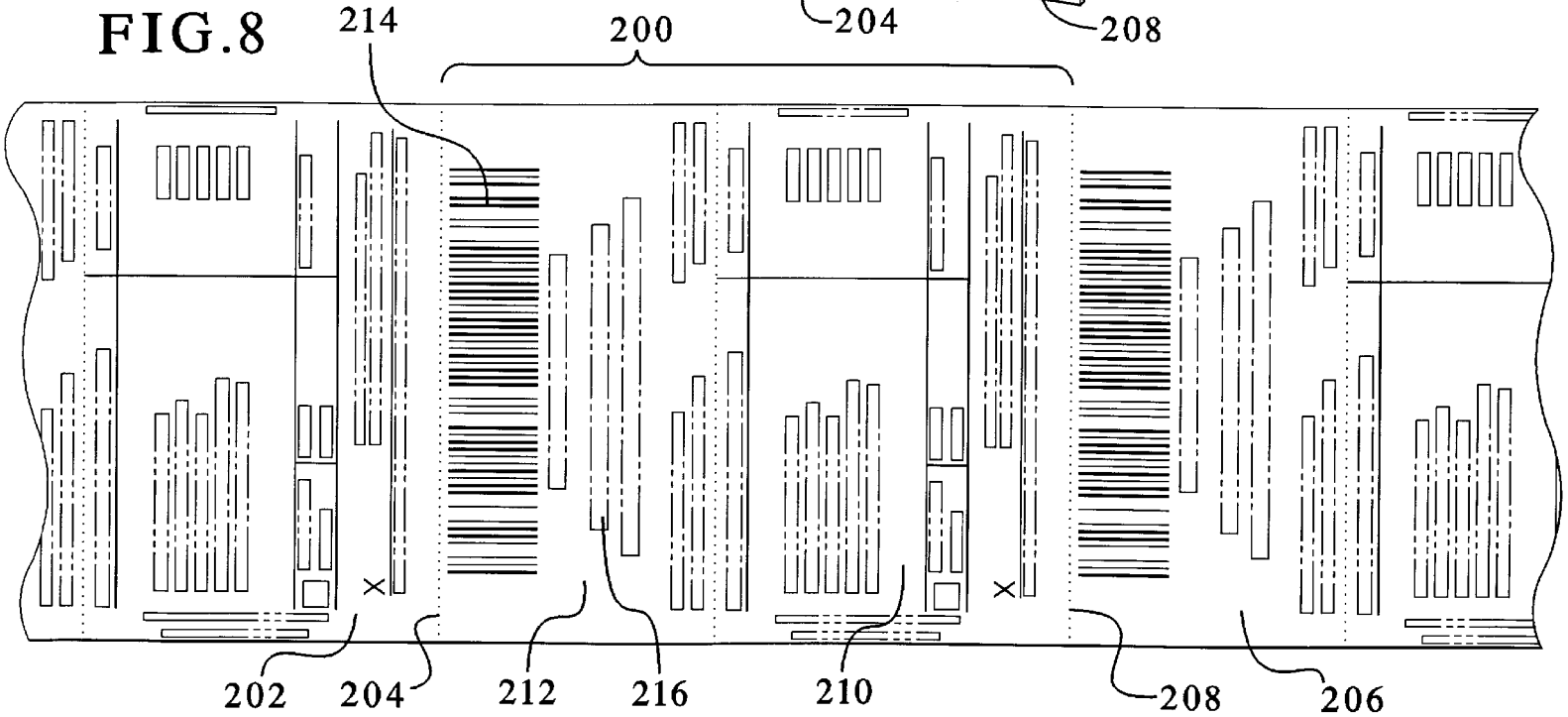
FIG. 8 illustrates a plan view of front sides of a plurality of mailing assemblies of the present invention detachably connected in end-to-end fashion.

FIG. 8 shows another embodiment of the present invention wherein a plurality of mailing assemblies are continuously and detachably interconnected (end-to-end, for example) such that the mailing assemblies may be provided on a reel or roll 250 as shown in FIG. 9. As shown in FIG. 8, a mailing assembly 200 may be detachably connected on a first edge to a second mailing assembly 202 via a tear line 204. The mailing assembly 200 may be further detachably connected on a second edge to a third mailing assembly 206 via tear line 208.

The mailing assembly 200 includes a mailing label 210 which corresponds to PS Form 2976. The mailing label 210 is detachably connected to a tracking area 212. The tracking area 212 includes a machine-readable code section 214 wherein the machine-readable information may be variably printed to correspond to a mailpiece. Further, the tracking area 212 includes an auxiliary information area section 216 which may be variably printed with information relating to the delivery of a mailpiece. The mailing assembly is a simplified mailing assembly to aid in the delivery of a mailpiece where a receipt card is not required or otherwise necessary.

FIG. 9 shows a plurality of mailing assemblies 200 connected in an end-to-end fashion in a reel or roll 250. Each mailing assembly 200 includes a mailing label 210 and a tracking area 212 detachably connected to each other via the tear line 208. Each of the mailing assemblies 200 is detachably connected to another mailing assembly 200 via the tear line 204.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A mailing assembly for use in connection with non-domestic delivery of a mailpiece holding contents for delivery thereof, the assembly comprising:

a continuous backing sheet of uniform thickness; and a mailing form removably attached to the backing sheet, the mailing form variably printed with information necessary to comply with requirements for the non-domestic delivery of the mailpiece including data concerning the contents of the mailpiece wherein a mailing label forms a first portion of the mailing form and a tracking area forms a second portion of the mailing form wherein the first portion of the mailing form and the second portion of the mailing form are both removable from the backing sheet.

2. The mailing assembly of claim 1 further comprising:

an adhesive layer between the mailing form and the backing sheet.

3. The mailing assembly of claim 1 further comprising:

a machine-readable code section in the tracking area including machine-readable information associated with the mailpiece.

4. The mailing assembly of claim 1 wherein the tracking area is detachable from the mailing label.

5. The mailing assembly of claim 1 further comprising:

a second mailing form removably attached to the backing sheet and detachably connected to the first mailing form.

6. The mailing assembly of claim 5 wherein an adhesive layer extends between the second mailing form and the backing sheet.

7. The mailing assembly of claim 5 further comprising:

a machine-readable code section on the second mailing form.

8. A mailing assembly for use in connection with non-domestic delivery of a mailpiece holding contents for delivery thereof, the assembly comprising:

a continuous backing sheet of uniform thickness;

a mailing form removably attached to the backing sheet, the mailing form variably printed with information necessary to comply with requirements for the non-domestic delivery of the mailpiece including data concerning the contents of the mailpiece;

a mailing label forming a first portion of the mailing form;

a tracking area forming a second portion of the mailing form; and a receipt card forming a third portion of the mailing form.

9. The mailing assembly of claim 8 wherein the backing sheet is removably attached to the mailing label and the tracking area and not the receipt card.

10. The mailing assembly of claim 8 further comprising:

a machine-readable code section on the tracking area including machine-readable information associated with the mailpiece.

11. The mailing assembly of claim 8 wherein the receipt card is detachable from the tracking area.

12. The mailing assembly of claim 8 wherein the tracking area is detachable from the mailing label.

13. The mailing assembly of claim 8 further comprising:

a second mailing form removably attached to the backing sheet and detachably connected to the first mailing form.

14. The mailing assembly of claim 8 wherein an adhesive layer extends between the mailing form and the backing sheet.

15. The mailing assembly of claim 13 further comprising:

a machine-readable code section on the second mailing form.

16. A method for preparing a mailpiece for non-domestic delivery of the mailpiece wherein the mailpiece has contents for delivery thereof, the method comprising the steps of:

providing a mailing form removably attached to a continuous backing sheet of uniform thickness wherein the mailing form has a mailing label forming a first portion of the mailing form and a tracking area forming a second portion of the mailing form wherein the tracking area is removably connected to the mailing label;

printing information on the form necessary to comply with requirements for the non-domestic delivery of the mailpiece including data relating to the contents of the mailpiece;

removing the form from the backing sheet; and attaching the form to the mailpiece.

17. The method of claim 16 further comprising the steps of:

providing a machine-readable code section on the tracking area; and printing machine-readable information associated with the mailpiece on the machine-readable code section.

18. The method of claim 16 further comprising the step of:

providing a receipt card forming a third portion of the mailing form wherein the receipt card is detachably connected to the tracking area.

19. The method of claim 18 further comprising the steps of:

entering sender information on the receipt card;

entering addressee information on the receipt card; and removing the receipt card from the tracking area.

20. The method of claim 16 further comprising the step of:

detaching the tracking area from the mailing label.

* * * * *

UNITED STATES PATENT AND TRADEMARK OFFICE

CERTIFICATE OF CORRECTION

PATENT NO. : 6,203,068 B1
DATED : March 20, 2001
INVENTOR(S) : Glenn Petkovsek

It is certified that error appears in the above-identified patent and that said Letters Patent is hereby corrected as shown below:

Column 1,
Line 51, change "an" to read -- and --.

Column 3,
Line 14, change "detachable" to read -- detachably --.
Line 43, change "connections" to read -- connection --.

Column 6,
Line 13, change "he" to read -- the --.
Line 14, change "390" to read -- 30 --.

Signed and Sealed this

Nineteenth Day of February, 2002

*Attest:*

*Attesting Officer*

JAMES E. ROGAN
*Director of the United States Patent and Trademark Office*